United States Patent [19]

Dameron

[11] Patent Number: 4,829,617

[45] Date of Patent: May 16, 1989

[54] BEDDING ATTACHMENT DEVICES

[76] Inventor: Patrick S. Dameron, 9375 Viscount Ave. #616, El Paso, Tex. 79925

[21] Appl. No.: 195,171

[22] Filed: May 18, 1988

[51] Int. Cl.[4] ..... A47C 21/02

[52] U.S. Cl. ..... 5/508; 5/498; 24/72.5; 24/306; 24/543

[58] Field of Search ..... 5/508, 496, 498; 24/72.5, 306, 543

[56] References Cited

U.S. PATENT DOCUMENTS

| | | | |
|---|---|---|---|
| 2,931,084 | 4/1960 | De Witt | 5/498 |
| 3,854,482 | 12/1974 | Laugherty etal. | 24/543 |
| 3,978,555 | 9/1976 | Weisenthal | 24/543 |
| 4,541,137 | 9/1985 | Murray | 24/72.5 |
| 4,656,697 | 4/1987 | Naslund | 24/543 |
| 4,660,240 | 4/1987 | Hutton et al. | 24/72.5 |
| 4,662,016 | 5/1987 | Secman | 5/508 |

FOREIGN PATENT DOCUMENTS

| | | | |
|---|---|---|---|
| 133939 | 9/1929 | Switzerland | 24/72.5 |

*Primary Examiner*—Alexander Grosz
*Attorney, Agent, or Firm*—Leon Gilden

[57] ABSTRACT

A first embodiment of a bedding attachment device includes a strip of hook fastening material which is attachable to a bed frame and a further strip of loop fastening material which is selectively attachable to the bedding. Garter-like fastening straps are fixedly secured to the loop strip, and these straps are attached to the bedding at selected positions. The bedding may then be stretched over the mattress until the hook and loop fastening strips are engaged. A second embodiment makes use of the hook and loop fastening straps; however, the garter-like straps are replaced by a rigid plastic clamp which may be snap fitted over the bedding.

2 Claims, 2 Drawing Sheets

BEDDING ATTACHMENT DEVICES

BACKGROUND OF THE INVENTION

1. Field of the Invention

The present invention relates to bedding fastening devices, and more particularly pertains to new and improved embodiments of bedding fasteners which are utilized to secure blankets, sheets, and other bed clothing over a bed.

2. Description of the Prior Art

Bedding fastening devices heretofore devised and utilized for the purpose of securing blankets, sheets, and the like to beds are known to consist basically of familiar, expected and obvious structural configurations. In this regard, each embodiment of bedding attachment device according the present invention substantially departs from the conventional concepts and designs of the prior art, and in so doing provides apparatuses primarily developed for holding bedding securely in position on any type of bed.

To more clearly understand the advantages of the present invention, a description of the most relevant prior art is provided. For example, U.S. Pat. No. 4,646,375, which issued to Parker on Mar. 3, 1987, discloses a typical known bed sheet fastener wherein first and second complementary pieces of adhesive material are arranged at each of the corners of sheets and at areas of a bed frame over which the mattress corners are positioned. In this respect, singular pieces of hook and loop fastening material are respectively provided on the bed sheets and frame, and are interconnected in an apparent manner to secure the bedding in place. While being functional for their intended purpose, the Parker fasteners provide only a singular tension point and cannot be adjustably tensioned without disconnecting the fastening materials.

Another conventional type of bed sheet fasteners which utilize hook and loop fastening materials is to be found in U.S. Pat. No. 4,488,323 which issued to Colburn on Dec. 18, 1984. As with the Parker device, the Colburn fasteners utilize singular points of attachment and cannot be readily adjusted in tension without a disconnection thereof. The same type of hook and loop fasteners are also shown in U.S. Pat. Nos. 4,040,133 which issued to Gilreath on Aug. 9, 1977; 3,066,323 which issued to Kintner on Dec. 4, 1962; and 4,015,299 which issued to Tinnel on Apr. 5, 1977. These patents also disclose fastening devices which possess the disadvantage of not being adjustably tensioned without a disconnection of the associated hook and loop fasteners. Further, all of the above-discussed bedding attachment devices provide for a stretched tensioning of an associated bed sheet in a single direction which can cause wrinkling of the bed, clothes, as well as user discomfort.

Therefore, it can be appreciated there is a continuing need for new and improved bedding fastener devices which can be adjustably tensioned without the requirement of disconnecting the associated hook and loop fasteners, while also providing adjustable tensioning in multiple directions so as to maximize user comfort. In this respect, the present invention substantially fulfills this need.

SUMMARY OF THE INVENTION

In view of the foregoing disadvantages inherent in the known types of bedding fastening devices now present in the prior art, the present invention provides for improved bedding fastening devices wherein the same can be adjustably tensioned in multiple directions without the necessity of having to lift a mattress within the bedframe structure. As such, the general purpose of the present invention, which will be described subsequently in greater detail, is to provide new and improved bedding fastening devices which have all the advantages of the prior art bedding fastening devices and none of the disadvantages.

To attain this, the present invention discloses two separate embodiments of bedding fastening devices which can be utilized to accomplish the desired multidirection tensioning of bedding materials. A first embodiment of a bedding attachment device includes a strip of hook fastening material which is attachable to a bed frame and a further strip of loop fastening material which is selectively attachable to the bedding. Garter-like fastening straps are fixedly secured to the loop strip, and these straps are attached to the bedding at selected spaced-apart positions. The bedding may then be stretched over the mattress until the hook and loop fastening strips are engaged. A second embodiment makes use of the hook and loop fastening straps; however, the garter-like straps are replaced by a rigid plastic clamp which may be snap fitted over the bedding.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved bedding fastening devices which have all the advantages of the prior art bedding fastening devices and none of the disadvantages.

It is another object of the present invention to provide a new and improved bedding fastening device which may be easily and efficiently manufactured and marketed.

It is a further object of the present invention to provide a new and improved bedding fastening device which are of a durable and reliable construction.

An even further object of the present invention is to provide a new and improved bedding fastening device which are susceptible of a low cost of manufacture with regard to both materials and labor, and which accordingly are then susceptible of low prices of sale to the consuming public, thereby making such bedding fastening devices economically available to the buying public.

Still yet another object of the present invention is to provide a new and improved bedding fastening device which provide in the apparatuses and methods of the prior art some of the advantages thereof, while simultaneously overcoming some of the disadvantages normally associated therewith.

Still another object of the present invention is to provide new and improved bedding fastening device which allow for multi-directional tensioning of associated bedding.

Yet another object of the present invention is to provide new and improved bedding fastening devices which permit adjustable tensioning of bedding without the necessity of lifting a mattress within a bed frame to accomplish such adjustable tensioning.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

With reference now to the drawings, and in particular to FIGS. 1, 2, 3 and 4 thereof, a first embodiment of a new and improved bedding fastening device embodying the principles and concepts of the present invention will be described.

More specifically, the first embodiment of the invention includes a strip 12 of hook material of the type commonly referred to as VELCRO®. The flexible hook material 12 may have a rigid through-extending grommet 14 which facilitates an attachment of the strip to a conventional bed frame.

Figure 1:
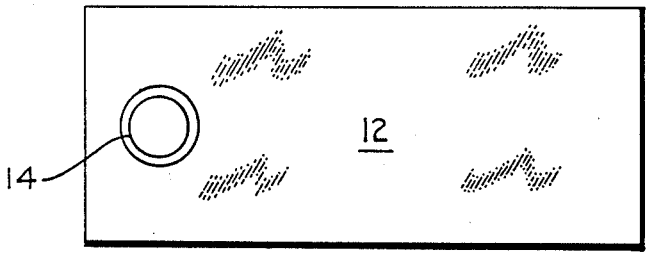
FIG. 1 is a top orthographic view of the instant invention.
Figure 2:
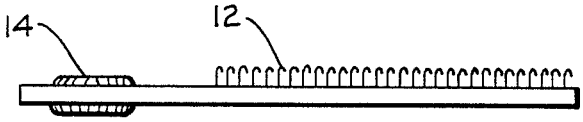
FIG. 2 is an orthographic view taken in elevation of the instant invention.
Figure 3:
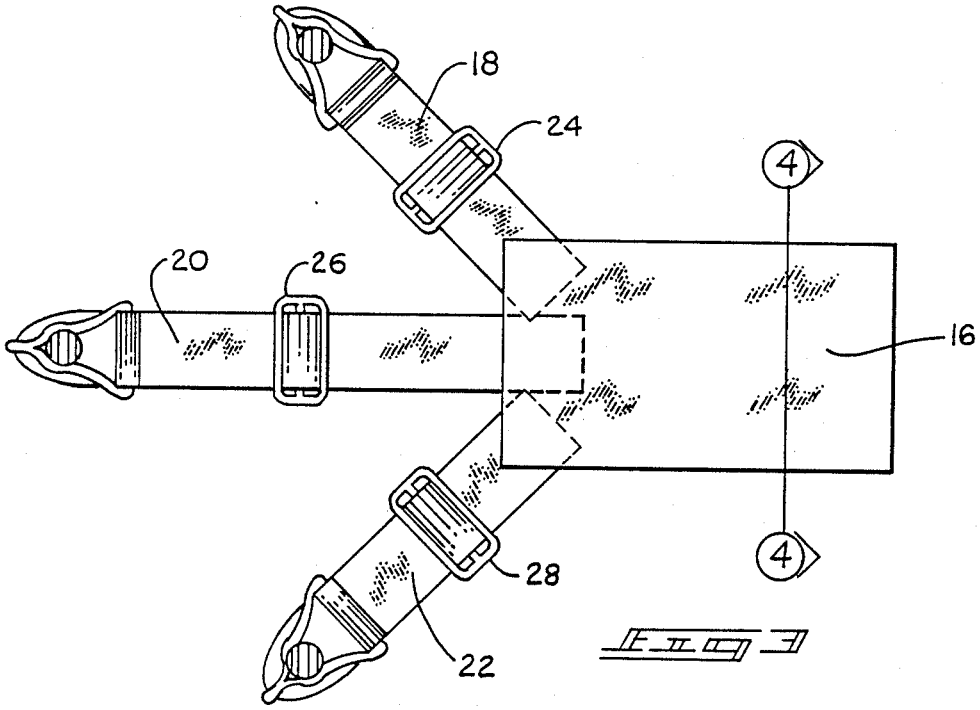
FIG. 3 is a top orthographic view of a further embodiment of the instant invention.
Figure 4:
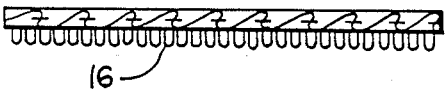
FIG. 4 is an orthographic view taken in elevation along the lines 4—4 of FIG. 3.

As illustrated in FIGS. 3 and 4, a second part of the first embodiment of the invention includes a further flexible material strip 16 with such strip being formed of a loop material so as to be selectively attachable to the aforementioned hook material 12. The strip 16 further includes a plurality of garter-like connectors 18, 20, 22 which are sewn or otherwise attached to the strip 16. The connectors 18, 20, 22 extend radially outward from the material strip 16 and are selectively attachable to bedding in a now apparent manner.

In use, it can be seen that once the connectors 18, 20, 22 are attached in three different positions on a corner of some bedding, the bedding may be stretched into position with the loop material forming the strip 12. As aforementioned, the strip 12 is attached by some conventional means to a bed frame. Once connected, adjustment rings 24, 26, 28 may be moved along the respective connectors 18, 20, 22 so as to adjust the tensioning of the bedding relative to the bed frame. Through the use of the adjustable garter-like connectors 18, 20, 22, a user need not lift a mattress upwardly out of the bed frame in order to adjust the tension on the bedding. More particularly, without the adjustable garter-like connectors 18, 20, 22, it would be necessary to lift the mattress to adjust the connection between the hook and loop fasteners 12, 16.

Figure 5:
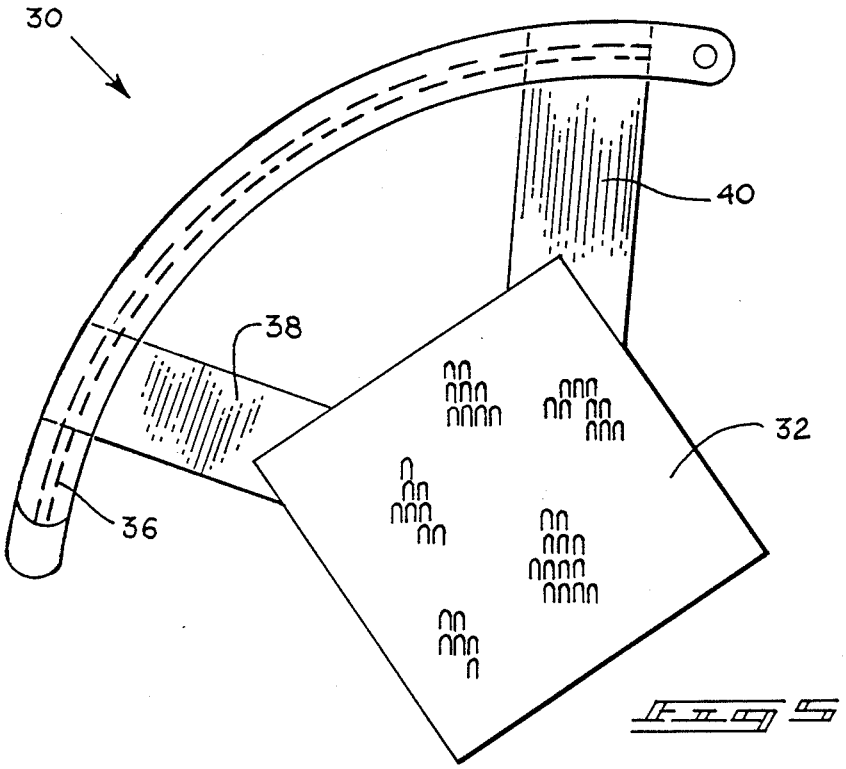
FIG. 5 is a top orthographic view of yet another embodiment of the instant invention.
Figure 6:
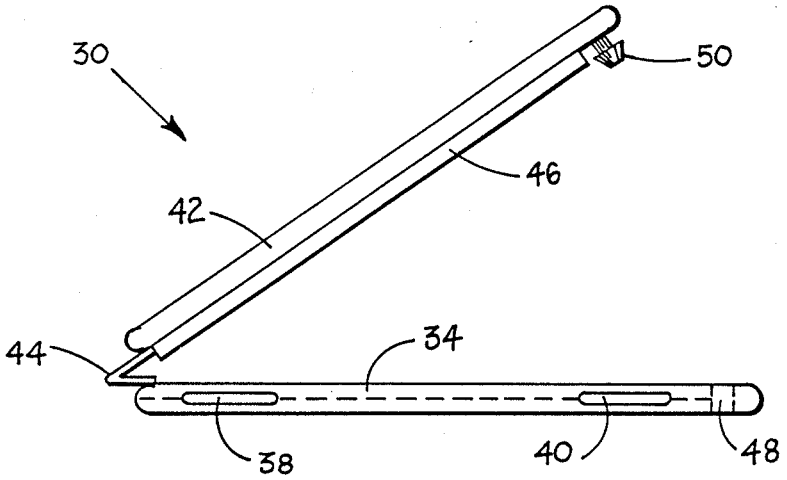
FIG. 6 is an orthographic end view taken in elevation of FIG. 5 of the further modification of the instant invention.

FIGS. 5 and 6 illustrate a modified embodiment of the invention generally designated by the reference numeral 30. The embodiment 30 also utilizes a flexible strip 32 of loop fastening material which is engagable with the aforediscussed hook fastening material strip 12. In this embodiment 30 of the invention however, the garter-like connectors have been replaced with a first semi-circular rigid plastic ring 34 having a curved groove 36 formed along a top surface thereof. The semi-circular ring 34 is connected to the flexible strip material 32 by a pair of further flexible strips 38, 40. The connecting strips 38, 40 can be formed of any flexible material, to include flexible plastic so as to allow the entire construction of the second embodiment 30 of the invention to be formed in a thermoplastic molding process.

With further reference to FIGS. 5 and 6 of the drawings, it will be noted that the semi-circular ring member 34 is hingedly connected to a further semi-circular ring 42 by means of a flexible plastic hinge member 44 integrally or otherwise attached therebetween. The semi-circular member 42 overlies the ring member 34 and has a downwardly extending ridge curved 46 which conformingly fits within the groove 36. A through-extending aperture 48 provided in the member 34 is designed to receive a flared connector 50 integrally attached to and extending downwardly from the semi-circular ring member 42. When the connector 50 is snap-fitted into the aperture 48, the ring members 34, 42 are in abutting engagement and the ridge 46 is retained within the groove 36.

With respect to the manner of usage of this second embodiment 30 of the invention, it can be seen that bedding may be positioned between the semi-circular ring members 34, 42 in a now apparent manner, and the connector 50 can then be forced into the aperture 48 to effect a secure engagement of the invention to the bedding. More specifically, the ridge member 46 will grippingly position the bedding within the groove 34 so as to effect a secure attachment of the invention thereto. Once the bedding has been attached between the ring members 34, 42, the loop material 32 can be selectively attached to the hook material 12 in the manner of the first embodiment of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bedding attachment device adapted to attach sheetlike bedding to a bed frame, comprising: a first strip of material comprising hook means, said strip adapted to be attached to a bed frame;

a second strip of material, adapted to be releaseably attached to said first strip of material, comprising loop means interengageable with said hook means; flexible connecting strips connected between the second strip and a bedding holding device, said bedding holding device comprising a first semi-circular member, as viewed in plan, hingely attached to a second semi-circular member, as viewed in plan, said first semi-circular member having a curved groove formed therein, said second semi-circular member having a curved ridge formed thereon, said ridge being frictionally engageable with said groove to effect a releasable engagement of bedding between the semi-circular members.

2. The bedding attachment device of claim 1, further including a flared connector on one of the semi-circular members, and a mating aperture on the other semi-circular member.

* * * * *